United States Patent [19]

Ohshita et al.

[11] 4,419,553

[45] Dec. 6, 1983

[54] VACUUM TYPE CIRCUIT BREAKER

[75] Inventors: Masayuki Ohshita, Amagasaki; Toshiaki Horiuchi, Settsu; Takashi Yamanaka, Itami; Yoshihiro Usui, Kawanishi, all of Japan

[73] Assignee: Mitsubishi Denki Kabushiki Kaisha, Tokyo, Japan

[21] Appl. No.: 336,433

[22] Filed: Dec. 31, 1981

[30] Foreign Application Priority Data

Jan. 19, 1981 [JP] Japan ..... 56-6799
Jan. 19, 1981 [JP] Japan ..... 56-6800

[51] Int. Cl.[3] ..... H01H 33/00
[52] U.S. Cl. ..... 200/144 B; 200/153 SC
[58] Field of Search ..... 200/144 B, 148 F, 153 SC, 200/144 R, 50 C, 50 A, 50 AA

[56] References Cited

U.S. PATENT DOCUMENTS 4,152,562 5/1979 Kohler et al. ..... 200/153 SC

FOREIGN PATENT DOCUMENTS 51-15225 5/1976 Japan .

OTHER PUBLICATIONS

J. Parry, Mechanical Aspects in the Design of Distribution Switchgear pp. 32–35.

*Primary Examiner*—Elliot A. Goldberg
*Assistant Examiner*—Morris Ginsburg
*Attorney, Agent, or Firm*—Lowe, King, Price & Becker

[57] ABSTRACT

A vacuum type circuit breaker which has an operating lever (31) connected at one end thereof to the movable electrode (102) of a vacuum switch tube (1) and at the other end to a closing spring (55) through an energy storage link mechanism (54). The operating lever (31) functions to drive the movable electrode (102). The energy storage link mechanism (54) is provided with an energy storage crank (52) pivotally supported on a shaft (2051). The force which the energy storage link mechanism (54) applies to the operating lever (31) is set such that it is less than a force on the operating lever (31) which is produced by the difference between the internal pressure of the vacuum switch tube (1) and atmospheric pressure. This arrangement makes it possible, upon occurrence of vacuum loss, to detect the vacuum shortage, whereupon the closing of the switch is prevented to thereby avoid an accident due to vacuum degradation.

4 Claims, 6 Drawing Figures

VACUUM TYPE CIRCUIT BREAKER

BACKGROUND OF THE INVENTION

1. Field of the Invention

This invention relates to a vacuum type circuit breaker of the type using the difference between the internal pressure of a vacuum switch tube and atmospheric pressure as a contact force for a movable electrode against a fixed electrode, and more particularly to an operating mechanism adapted to make the closing of the switch impossible upon occurrence of vacuum loss in the vacuum switch tube.

2. Description of the Prior Art

Japanese Patent Publication No. 15225/1976 discloses an example of a device of this type. The disclosed vacuum type circuit breaker, which is adapted to use the difference between the internal pressure of the vacuum switch tube and atmospheric pressure as a contact pressure for the movable electrode of the vacuum switch tube against the fixed electrode thereof, comprises an electromagnet for imparting a closing operative force to the movable electrode, and a return spring for separating the movable electrode from the fixed electrode, the arrangement being such that when vacuum loss occurs in the vacuum switch tube, the equilibrium between the opening force of the return spring and the difference between the internal pressure of the vacuum switch tube and atmospheric pressure is upset, so that even if a closing instruction is given to energize the electromagnet, the closing of the switch is prevented because of the upset of equilibrium among the attraction of the electromagnet, the opening force of the return spring and the difference between the internal pressure of the vacuum switch tube and atmospheric pressure.

However, this conventional vacuum type circuit breaker, because of its arrangement described above, has not only the disadvantage of requiring a power source of large capacity for operating the electromagnet but also the disadvantage of being very unstable in that variations in the operating power source voltage cause variations in the closing speed or upset the equilibrium of forces to the extent that the closing of the switch is no longer possible. Further, upon occurrence of an operating power source failure, low speed closing must be manually effected. Thus, it also has a drawback from the standpoint of safety.

U.S. Pat. No. 4,152,562 issued May 1, 1979 and entitled "Driving Mechanism For Switching Apparatus With Pressure Contacts" discloses the relation between an electrode-opening spring and atmospheric pressure in a spring-operated vacuum type circuit breaker which is different from the solenoid-operated type described above. Similarly, in "Developments In Distribution Switchgear" in Conference Publication Number 168, J. Parry describes the relation between an electrode opening spring and atmospheric pressure in a vacuum type circuit breaker. These two prior techniques disclose that it is necessary for the opening spring to overcome the force applied to the contacts of the vacuum type circuit breaker by atmospheric pressure.

SUMMARY OF THE INVENTION

This invention has been developed to eliminate the drawbacks inherent in the conventional devices described above and has for its object the provision of a vacuum type circuit breaker comprising, in combination, coils springs having a linear energy curve and a link mechanism, the arrangement being such that, when vacuum is lost in a vacuum switch tube, the equilibrium between the rotational energy of said link mechanism and the difference between the internal pressure of the vacuum switch tube and atmospheric pressure is upset to thereby prevent the closing of the switch and, at the same time, the lost vacuum is detected to avoid an accident otherwise caused by such a vacuum loss.

Another object of the invention is to provide a vacuum type circuit breaker which is simple in construction and which has an operating mechanism having a quick closing and opening function and a trip function.

A vacuum type circuit breaker according to the invention has an operating lever connected at one end thereof to the movable electrode of a vacuum switch tube to drive said movable electrode, the other end of said operating lever having a closing spring connected thereto through an energy storage link mechanism provided with an energy storage crank pivotally supported on a shaft. The force applied to the operating lever by the energy storage link mechanism is set such that prior to the closing of the vacuum switch tube, said force is less than a force applied to said operating lever in a direction opposite to that of said link force by the self-closing force of the vacuum switch tube resulting from the difference between the internal pressure of the vacuum switch tube in its normal state and atmospheric pressure.

With the vacuum switch tube in its normal state, because of said self-closing force overcoming said link force, the energy storage crank is turned through the operating lever, causing the line of action of the closing spring to pass across the point of connection between the energy storage crank and the closing spring and across the dead point defined by the shaft of the energy storage crank, whereby the direction of the link force applied to the operating lever by the energy storage link mechanism is reversed and the operating lever functions to rapidly close the vacuum switch tube under the storage force of said closing spring and the self-closing force of the vacuum switch tube.

On the other hand, if the self-closing force of the vacuum switch tube is reduced by vacuum loss taking place in the vacuum switch tube, it is impossible for said line of action of the closing spring to pass across said dead point, thereby making the closing of the vacuum switch tube impossible.

Further, the operating lever is provided with a cut-off spring and a trip latch mechanism, the arrangement being such that releasing said trip latch mechanism turns the operating lever under the stored energy of the cut-off spring, so that the vacuum switch tube is quickly opened.

According to this invention, the energy storage link mechanism is designed to convert the stored energy of the closing spring into a torque whose direction can be changed from a clockwise to a counterclockwise direction and vice versa. This energy storage link mechanism controls the relation between the self-closing force of the vacuum switch tube and the link force due to the closing spring when the breaker is to be closed. Thus, it is possible to provide an arrangement wherein the closing becomes impossible should a vacuum loss in any one of three vacuum switch tubes forming a three-phase power system. Therefore, as soon as a vacuum shortage is detected, the closing operation becomes impossible, thereby providing the merit of precluding vacuum degradation of two or more vacuum switch tubes and hence an accident otherwise caused by such vacuum degradation. Further, since these mechanisms are designed to operate, upon completion of energy storage of the closing spring, exclusively under the control of the equilibrium relation between the self-closing force of the vacuum switch tube and the closing spring force, there are such merits, which were not attainable in the past, as absence of unstability due to variations in the operating power source voltage and manual closability of the switch even during power failure.

These objects and other objects, features, aspects and advantages of the present invention will become more apparent from the following detailed description of the present invention when taken in conjunction with the accompanying drawings.

BRIEF DESCRIPTION OF THE DRAWINGS

FIGS. 2 through 4 are schematic views showing an embodiment of an operating mechanism according to the invention, wherein FIG. 2 shows a cut-off state, FIG. 3 shows an intermediate state and FIG. 4 shows a closed state;

DESCRIPTION OF THE PREFERRED EMBODIMENTS

FIGS. 1 through 4 show an embodiment of a vacuum type breaker according to the present invention.

Figure 1:
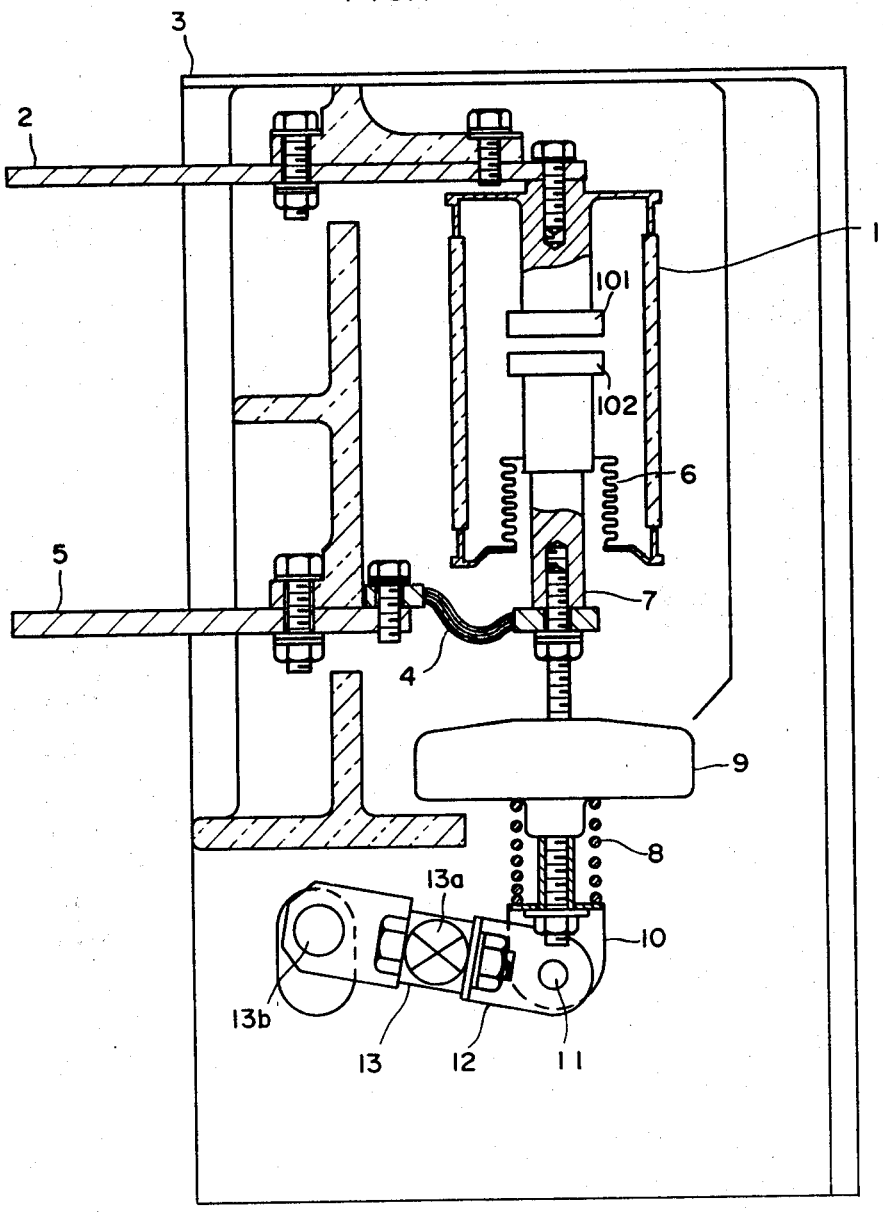
FIG. 1 is a partial sectional view showing part of a vacuum type circuit breaker according to an embodiment of the present invention, particularly illustrating a vacuum switch tube and its associated parts.
Figure 2:
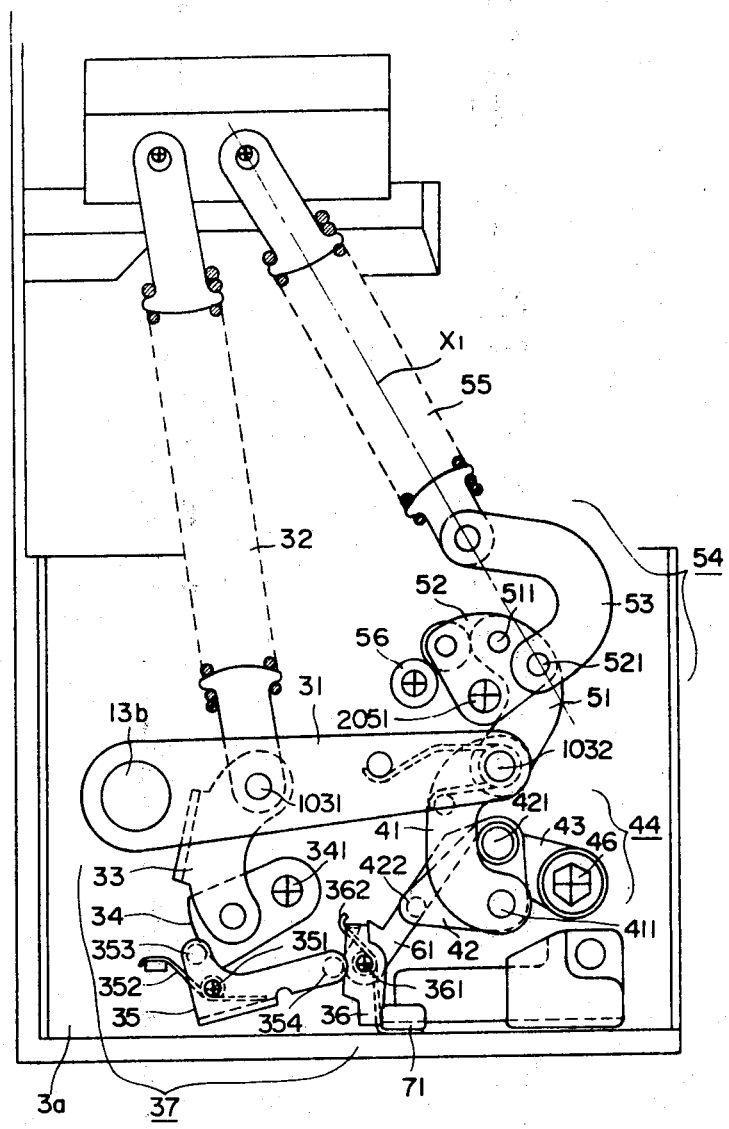
Figure 3:
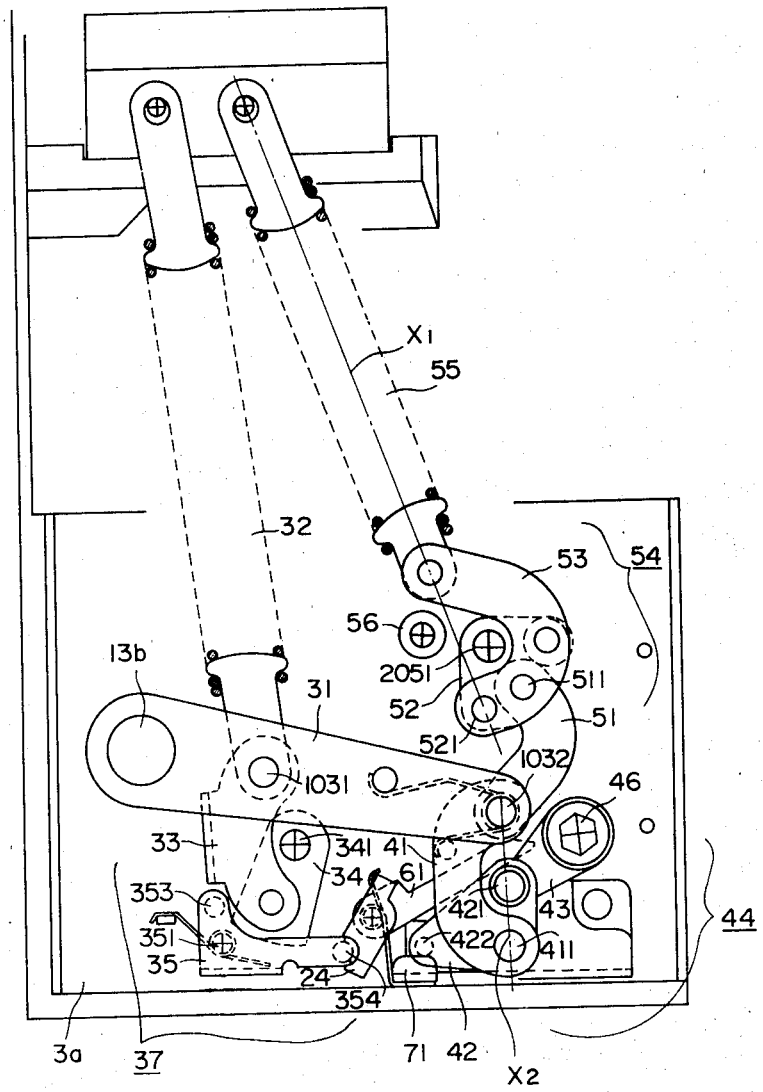
Figure 4:
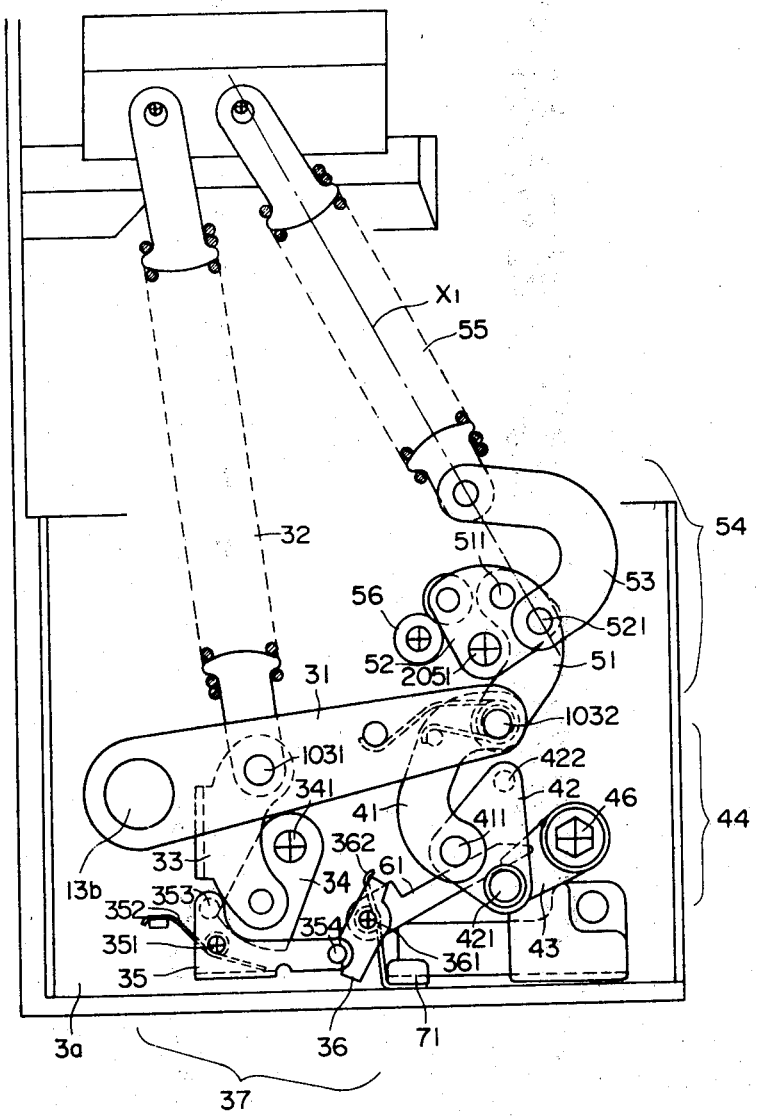

In FIG. 1, a vacuum switch tube 1 is fixed to an insulation frame 3 through an upper terminal 2, with the current path extending from the upper terminal 2 successively through the fixed electrode 101 of the vacuum switch tube 1, its movable electrode 102 and a shunt 4 to a lower terminal 5. A bellows 6 is joined to a movable rod 7 for the vacuum switch tube 1. The numeral 8 denotes an auxiliary spring for imparting a contact pressure to the movable electrode 102 against the fixed electrode 101. As for the contact pressure on the movable electrode 102 urging the latter toward the fixed electrode 101, besides said pressure due to said auxiliary spring 8, the vacuum switch tube 1 has the self-closing force due to the difference between the internal pressure of the vacuum switch tube 1 and atmospheric pressure. Though not shown, there are three said vacuum switch tubes 1 respectively connected to the circuits of a three-phase power system. The movable rod 7 of the vacuum switch tube for each phase circuit is connected to a main shaft 13 successively through an insulation mold 9 for isolating the electricity receiving side of the movable rod 7 from the earth side, a link 10, a shaft 11 and a link 12. The main shaft 13 is rotatably supported in a bearing **13*a* on the insulation frame 3 and is engaged with an operating mechanism section by means of a connector 13*b*. FIGS. 2 through 4 show the operating mechanism section, wherein FIG. 2 shows a cut-off state, FIG. 3 shows an intermediate state, and FIG. 4 shows a closed state. In FIGS. 2 through 4, the numeral 31 denotes an operating lever pivotally connected at one end thereof to the connector 13*b* fixed to said main shaft 13. The operating lever 31 is connected to a cut-off spring 32 through a pin 1031 provided in the intermediate portion thereof, so that it is upwardly urged by said cut-off spring 32. The operating lever 31 is pivotally connected to one end of a latch arm 33 by the pin 1031. The other end of the latch arm 33 is pivotally connected to a sector latch 34 pivotally supported on a shaft 341. An L-shaped latch 35 is pivotally supported on a shaft 351 and urged clockwise by a spring 352 at all times. The ends of the L-shaped latch 35 are provided with pins 353 and 354. A trip latch 36 is pivotally supported on a shaft 361 and urged clockwise by a spring 362 at all times. The sector latch 34 engages the pin 353 on the L-shaped latch 35, while trip latch 36 engages the pin 354 on the L-shaped latch 35. The latch arm 33, sector latch 34, L-shaped latch 35 and trip latch 36 constitute a trip latch mechanism 37**.

A closing arm 41 is connected at one end thereof to a pin 1032 provided on the other end of the operating lever 31. A closing link 42 is triangular and is pivotally connected to the other end of the closing arm 41 by a pin 411. A closing lever 43 is fixed to a closing shaft 46 adapted to be turned by an electric motor or a manual handle (neither one shown). The closing lever 43 is pivotally connected to the link 42. A trip lever 61 is pivotally supported on a shaft 361, and is engaged with the trip latch 36, so that it is urged clockwise by said trip latch 36 at all times. One end of the trip lever 61 is engaged with a pin 421, so that it is turned around the axis of the shaft 361 as it follows the movement of the pin 421. The closing arm 41, closing link 42 and closing lever 43 constitute a closing link mechanism 44.

An energy storage link 51 is connected at one end thereof to the pin 1032 on the operating lever 31. An energy storage crank 52 is pivotally supported on a shaft 2051 and is pivotally connected to the other end of the energy storage link 51 by a pin 511. An energy storage joint 53 is pivotally connected at one end thereof to the energy storage crank 52 by a pin 521 and is connected at the other end to a closing spring 55. A stop 56 is provided for limiting the turning movement of the energy storage crank 52. The energy storage link 51, energy storage crank 52 and energy storage joint 53 constitute an energy link mechanism 54.

The numeral 71 denotes a trigger fixed to a box **3*a***.

The operation of the vacuum type circuit breaker will now be described in accordance with the course of operation including the cut-off state (FIG. 2), the intermediate state (FIG. 3 ) and the closed state (FIG. 4).

If the vacuum switch tube 1 is in its open state, as shown in FIG. 1, then the operating mechanism section is in the state shown in FIG. 2. At this time, the stored energy A of the closing spring 55 and the link force F applied to the operating lever 31 by the stored energy of the closing spring 55 through the energy storage link mechanism 54 are of the size corresponding to a point of time $t_0$. In this connection, if the closing lever 43 is turned counterclockwise by the motor or by hand through the closing shaft 46, the operating lever 31 is turned clockwise around the axis of the connector **13*b* (a first fulcrum) through the closing link 42 and the closing arm 41, to assume the FIG. 3 state. As a result, the cut-off spring 32 connected to the intermediate portion of the operating lever 31 is stretched to store energy, while the latch arm 33 connected to the operating lever 31 is downwardly moved from the FIG. 2 position to the FIG. 3 position, whereby the sector latch 34 connected to the latch arm 33 is turned counterclockwise around the axis of the shaft 341, moving across the pin 353 to assume the FIG. 3** position.

On the other hand, as the closing lever 43 is turned counterclockwise from the FIG. 2 position, the trip lever 61 follows the movement of the pin 421 and is turned around the axis of the shaft 361 together with the trip latch 36 under the force of the spring 362. As shown in FIG. 3, the notched portions of the trip latch 36 engages the pin 354 of the L-shaped latch 35. As a result, the trip mechanism 37 is locked, with the central portion of the operating lever 31 being locked through the pin 1031; thus, the pin 1031 functions as a second fulcrum.

Figure 5:
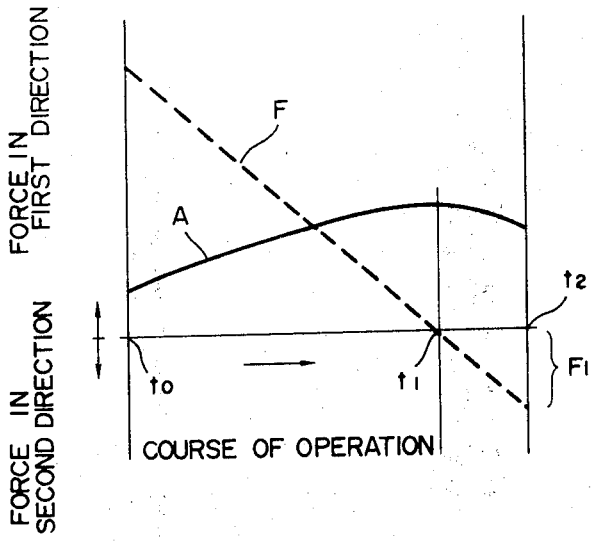
FIG. 5 is an explanatory view wherein the stored energy A of a closing spring and a link force F applied to an operating lever through an energy storage link mechanism are shown in relation to the course of operation.

On the other hand, when the operating lever 31 is turned clockwise around the axis of the connector **13*b* from the FIG. 2 position, the energy storage crank 52 is turned clockwise around the axis of the shaft 2051 by the energy storage link 51. When the line of action X1 of the closing spring 55 reaches the shaft 2051 because of the turning movement of the energy storage crank 52, that is, at a point of time $t_1$, the stored energy of the closing spring 55 is at a maximum, as shown in FIG. 5, but the link force F acting on the operating lever 31 is zero. When the line of action X1 reaches the left side of the shaft 2051, the energy storage crank 52 is reversed and the stored energy of the closing spring 55 acts to turn the energy storage crank 52 clockwise around the axis of the shaft 2051. Therefore, the link force F applied to the operating lever 31 is reversed to act such that it urges the operating lever 31 in a second direction, i.e., clockwise around the axis of the pin 1031. In this way, the operating mechanism section is moved from the FIG. 2 position to the FIG. 3 position. The FIG. 3 position corresponds to a point of time $t_2$ in FIG. 5, where a link force F1 acts on the operating lever 31 to urge the latter clockwise around axis of the shaft 1031**.

Further, in the FIG. 3 state, the line X2 which connects the pin 411 of the closing arm 41 and the pin 1032 passes substantially through the center of the pin 421 which connects the closing lever 43 and closing link 42, so that the closing link 42 is in a state where it is subjected to almost no torque produced by the stored energy of the closing spring 55 and therefore is not turned. In this state, when the trigger 71 is urged to upwardly move the pin 422 of the closing link 42, the line X2 connecting the pins 411 and 1032 is moved to the left side of the pin 421, so that the stored energy of the closing spring 55 acts to turn the pin 42 clockwise around the axis of the pin 421 through the energy storage link mechanism 54 and closing arm 41.

The self-closing force of the vacuum switch tube 1 based on the difference between the internal pressure of the vacuum switch tube and atmospheric pressure, i.e., the force urging the movable electrode 102 toward the fixed electrode 101 is transmitted to the operating lever 31 successively through the movable rod 7, insulation mold 9, link 10, shaft 11, link 12, main shaft 13 and connector **13*b*, whereby the operating lever 31 is urged counterclockwise around the axis of the pin 1032**.

Figure 6:
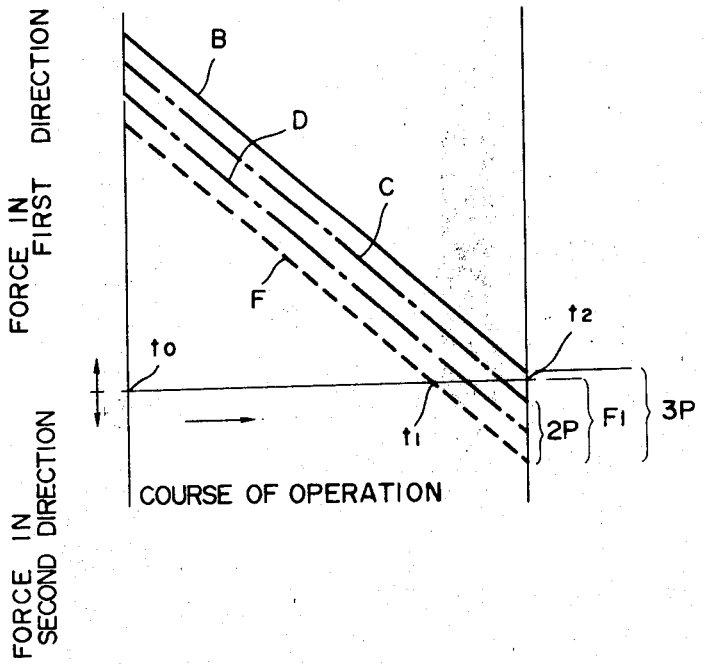
FIG. 6 is an explanatory view wherein the resultants B, C and D of the link force F and the self-closing force of a vacuum switch tube are shown in relation to the course of operation.

In FIG. 6, the resultant of the self-closing force of the vacuum switch tube and the force F applied to the operating lever 31 is shown in relation to the course of operation. Now, let P be the self-closing force of one vacuum switch tube. An operating force which results when 3P, which is the sum of the self-closing forces of three vacuum switch tubes for a three-phase power system, and the link force F are both applied to the operating lever 31, is shown by a line B; an operating force due to the sum 2P of the self-closing forces of two vacuum switch tubes for two circuits of the system is shown by a long-and-short alternate dash line C; and an operating force due to the self-closing force of one vacuum switch tube and the link force F is shown by a long-and-short alternate dash line D.

With the operating mechanism section in the FIG. 3 state, i.e., at the point of time $t_2$ shown in FIG. 6, if all of the three vacuum switch tubes 1 constituting the three-phase power system are normal, the total self-closing force 3P of the vacuum switch tubes will impart a counterclockwise torque around the axis of the pin 1031 to the operating lever 31. This counterclockwise torque based on the total self-closing force 3P is greater than the clockwise lnk force F1 around the axis of the pin 1031 of the operating lever 31 produced by the stored energy of the closing spring 55, as shown at the point of time $t_2$ in FIG. 6, thus overcoming the same. Therefore, the operating lever 31 is turned counterclockwise around the axis of the pin 1031. This counterclockwise turning of the operating lever 31 pushes the energy storage link 51 upwardly as viewed in FIG. 3, so that the energy storage crank 52 is turned counterclockwise around the axis of the shaft 2051 through the pin 511. As a result of the counterclockwise turning of the energy storage crank 52, the line of action X1 of the closing spring 55 is moved from the left-hand side to the right-hand side of the shaft 2051, whereupon the stored energy of the closing spring 55 which, has up to now been urging the energy storage crank 52 clockwise, acts to turn the energy storage crank 52 in the opposite direction, i.e., counterclockwise, thereby quickly turning the energy storage crank 52 counterclockwise. When the energy storage crank 52 is quickly turned counterclockwise, the energy storage link 51 pivotally connected to the energy storage crank 52 by the pin 511 is quickly pushed upwardly, so that the operating lever 31 is quickly turned counterclockwise around the axis of the pin 1031. That is, the stored energy of the strong closing spring 55 is capable of acting to quickly turn the operating lever 31 counterclockwise through the energy storage crank 52 and energy storage link 51. When the operating lever 31 is quickly turned counterclockwise around the axis of the pin 1031, it quickly depresses the connector **13*b* connected to one end of the operating lever 31. This quick downward movement of the connector 13*b* turns the main shaft 13*a* of FIG. 1 counterclockwise. Therefore, the movable electrode 102 of the vacuum switch tube 1 for each phase circuit is quickly brought into contact with the fixed electrode 101, and the closing operation is thus completed. This closing-completed state is shown in FIG. 4**.

After the vacuum switch tube 1 has been closed, the self-closing force of the vacuum switch tube 1 cooperates with the auxiliary spring 8 to provide a contact pressure on the movable electrode 102. Further, in the closing-completed state shown in FIG. 4, the link force F due to the stored energy of the closing spring 55 is acting on the operating lever 31 with a magnitude corresponding to the point of time $t_0$ shown in FIG. 6, as in the case of the cut-off state shown in FIG. 2.

A description will now be given of an operation which takes place if an abnormality occurs in at least one of the circuits of the three-phase power system. For example, if a vacuum loss occurs in a vacuum switch tube 1 associated with one of the circuits of the system, the link force F1 due to the stored energy of the closing spring 55, i.e., the force acting to turn the operating lever 31 clockwise around the axis of the shaft 2051, in the closed state of FIG. 3, i.e., at the point of time $t_2$ of FIG. 6, is the same as in the case of the normal state described above. In this case, the total closing force of the vacuum switch tubes 1 is 2P, and the force based on this closing force acting to turn the operating lever 31 counterclockwise is as shown by the long-and-short alternate dash line C in FIG. 6. Therefore, the energy storage crank 52 cannot be turned counterclockwise from the state shown in FIG. 3, nor can the line of action X1 of the closing spring be moved from the state shown on the left-hand side of the shaft 2051 in FIG. 3 to the right-hand side of the shaft 2051. Thus, the stored energy of the closing spring 55 cannot turn the operating lever 31 counterclockwise around the axis of the pin 1031. As a result, the operating mechanism section cannot be moved from the FIG. 3 state to the FIG. 4 state, so that the vacuum switch tubes 1 cannot be closed. Thus, it will be understood that if lost vacuum takes place in a vacuum switch tube 1, the vacuum type circuit breaker becomes unable to close. In addition, in the case of two of the three vacuum switch tubes having lost vacuum, i.e., the self-closing force P of only one vacuum switch tube being active, it will be understood that closing cannot be effected.

A description will now be given of a case where the vacuum type circuit breaker should be cut off from the closed state of FIG. 4.

In the state shown in FIG. 4, if the closing shaft 46 is turned clockwise by the motor or by hand, the closing lever 43 is also turned clockwise, whereby the trip lever 61 is turned counterclockwise. This counterclockwise turning of the trip lever 61 causes the counterclockwise turning of the trip latch 36, so that the pin 354 of the L-shaped latch 35 is disengaged from the notched portion of the trip latch 36. At this time, the stored energy of the cut-off spring 32 is applied to the pin 353 of the L-shaped latch 35 through the latch arm 33 and sector latch 35, urging the L-shaped latch 35 counterclockwise. Therefore, the disengagement of the pin 354 from the notched portion of the trip latch 35 quickly turns the L-shaped latch 35. As a result of this quick turning of the L-shaped latch 35, the engagement between the pin 353 and the sector latch 34 is canceled, so that the operating lever 31 is quickly turned clockwise around the axis of the pin 1032 by the stored energy of the cut-off spring 32, thereby assuming the cut-off state shown in FIG. 2. As a result of this quick clockwise turning of the operating lever 31, the connector **13*b* is moved from the FIG. 4 position to the FIG. 2 position. Accordingly, the main shaft 13*a* is turned clockwise to separate the movable electrode 102 of each vacuum switch tube 1 from the fixed electrode 101**, thus completing the cut-off operation.

In addition, even if the trip latch 36 is directly turned counterclockwise in response to, e.g., a circuit abnormality without the closing shaft 46 being turned, the same cut-off operation can be attained.

Although the present invention has been described and illustrated in detail, it is clearly understood that the same is by way of illustration and example only and is not to be taken by way of limitation, the spirit and scope of the present invention being limited only by way of the terms of the appended claims.

What is claimed is:

1. A vacuum type circuit breaker comprising an energy storage link mechanism having an energy storage crank pivotally supported on a shaft, a closing spring having a line of action, the spring connected at one end thereof to said energy storage link mechanism, an operating lever connected at one end thereof to a movable electrode of a vacuum switch tube and at another end thereof to said energy storage link mechanism, and a pivotal connection between a trip latch mechanism and a connector disposed between the ends of said operating lever, wherein when said vacuum switch tube is in its open state and when said operating lever has been latched by said trip latch mechanism, said energy storage link mechanism applies energy stored in said closing spring to said another end of said operating lever as a link force in a direction which turns said operating lever around an axis of the connection to said trip latch mechanism to open the vacuum switch tube, said link force being set by said energy storage link mechanism such that it is less than a force applied to said operating lever so that the latter is turned around the axis of the connection to said trip latch mechanism by a self-closing force applied to the movable electrode of the vacuum switch tube by a difference between internal pressure of the vacuum switch tube and atmospheric pressure, and wherein the self-closing force of said vacuum switch tube overcomes said link force so as to turn said operating lever around the axis of said connection in a direction which closes the vacuum switch tube, while turning the energy storage crank, whereby the line of action of said closing spring passes across the connection between said energy storage link mechanism and the closing spring and across a dead point defined by said shaft, whereby said link force applied to said another end of said operating lever by said energy storage link mechanism is reversed to turn said operating lever around the axis of the connection to said trip latch mechanism, so that the electrodes of said vacuum switch tube are quickly closed under the action of the stored energy of said closing spring and the self-closing force of said vacuum switch tube.

2. A vacuum type circuit breaker as set forth in claim 1, wherein said link force is set such that if the self-closing force of the vacuum switch tube decreases as a result of a vacuum breakdown taking place therein, it is no longer possible for said self-closing force to overcome the link force which is applied to the operating lever by the energy storage link mechanism in a direction which opens the vacuum switch tube and hence the closing of the vacuum switch tube becomes impossible.

3. A vacuum type circuit breaker as set forth in claim 2, wherein there are three vacuum switch tubes one for each of a plurality of circuits of a three-phase power system and the link force is set such that if a vacuum breakdown takes place in at least one of the vacuum switch tubes to decrease the self-closing force thereof, the closing of all the vacuum switch tubes becomes impossible.

4. A vacuum type circuit breaker as set forth in claim 1, wherein a cut-off spring is connected to the operating lever, so that by removing latch action provided by the trip latch mechanism, stored energy of said cut-off spring quickly turns the operating lever around the axis of the connection to the energy storage link mechanism, thereby cutting off the vacuum switch tube.

* * * * *